US010955793B2

(12) United States Patent
Kishi

(10) Patent No.: US 10,955,793 B2
(45) **Date of Patent: *Mar. 23, 2021**

(54) DRUM UNIT HAVING ELECTRICAL CONTACT SURFACE POSITIONED AT OUTER SURFACE OF FRAME AND IMAGE FORMING APPARATUS PROVIDED WITH THE SAME

(71) Applicant: BROTHER KOGYO KABUSHIKI KAISHA, Nagoya (JP)

(72) Inventor: Isao Kishi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/539,393

(22) Filed: Aug. 13, 2019

(65) Prior Publication Data

US 2019/0369550 A1 Dec. 5, 2019

Related U.S. Application Data

(63) Continuation of application No. 15/941,182, filed on Mar. 30, 2018, now Pat. No. 10,401,782.

(30) Foreign Application Priority Data

Aug. 1, 2017 (JP) ..... JP2017-149329

(51) Int. Cl.
*G03G 21/18* (2006.01)
*G03G 21/16* (2006.01)

(52) U.S. Cl.
CPC ..... *G03G 21/1821* (2013.01); *G03G 21/1623* (2013.01); *G03G 21/1633* (2013.01);
(Continued)

(58) Field of Classification Search
CPC ... G03G 2221/1684; G03G 2221/1623; G03G 2221/1647; G03G 2221/1671;
(Continued)

(56) References Cited

U.S. PATENT DOCUMENTS 10,401,782 B2 * 9/2019 Kishi ..... G03G 21/1853
2004/0022556 A1 2/2004 Nomura
(Continued)

FOREIGN PATENT DOCUMENTS

JP 2003-280491 A 10/2003
JP 2006-84828 A 3/2006
(Continued)

OTHER PUBLICATIONS

International Search Report and Written Opinion issued in related International Patent Application No. PCT/JP2018/013533, dated Jun. 12, 2018.
(Continued)

*Primary Examiner* — Carla J Therrien
(74) *Attorney, Agent, or Firm* — Merchant & Gould P.C.

(57) ABSTRACT

A drum unit includes: a frame; a first photosensitive drum; a second photosensitive drum; a charger; and a storage medium. The frame includes: a first frame plate; a second frame plate spaced apart from the first frame plate in a first direction; a third frame plate connecting one end of the first frame plate to one end of the second frame plate; and a fourth frame plate connecting another end of the first frame plate to another end of the second frame plate. The first photosensitive drum and the second photosensitive drum are rotatably supported by the frame. The second photosensitive drum is spaced apart from the first photosensitive drum and positioned closer to the third frame plate than the first photosensitive drum to the third frame plate in a second direction. The storage medium has an electrical contact
(Continued)

surface positioned at an outer surface of the fourth frame plate.

19 Claims, 10 Drawing Sheets

(52) U.S. Cl.
CPC ..... *G03G 21/1647* (2013.01); *G03G 21/1671* (2013.01); *G03G 21/1853* (2013.01); *G03G 21/1857* (2013.01); *G03G 21/1871* (2013.01)

(58) Field of Classification Search
CPC ... G03G 2221/1857; G03G 2221/1821; G03G 2221/1853; G03G 2221/1871; G03G 2221/1878; G03G 2221/1882; G03G 2221/1885
See application file for complete search history.

(56) References Cited

U.S. PATENT DOCUMENTS

| | | | | |
|---|---|---|---|---|
| 2008/0081278 | A1* | 4/2008 | Matsumoto ..... | G03G 9/09708 430/111.35 |
| 2008/0159772 | A1 | 7/2008 | Koishi et al. | |
| 2008/0159775 | A1 | 7/2008 | Koishi et al. | |
| 2009/0142103 | A1 | 6/2009 | Chaudhuri et al. | |
| 2009/0269100 | A1 | 10/2009 | Hashimoto | |
| 2010/0135693 | A1 | 6/2010 | Okabe et al. | |
| 2010/0329757 | A1 | 12/2010 | Souda | |
| 2011/0075213 | A1 | 3/2011 | Murayama | |
| 2011/0075214 | A1 | 3/2011 | Murayama | |
| 2011/0236048 | A1* | 9/2011 | Mukai ..... | G03G 15/2039 399/70 |
| 2012/0148288 | A1 | 6/2012 | Okabe et al. | |
| 2014/0055016 | A1 | 2/2014 | Nishikawa et al. | |
| 2015/0147090 | A1 | 5/2015 | Sato et al. | |
| 2015/0370219 | A1 | 12/2015 | Ogino et al. | |
| 2016/0091858 | A1* | 3/2016 | Shiraki ..... | G03G 21/1676 399/12 |
| 2016/0258490 | A1 | 9/2016 | Sasaki et al. | |

FOREIGN PATENT DOCUMENTS

| | | | |
|---|---|---|---|
| JP | 2008-165023 | A | 7/2008 |
| JP | 2009-265390 | A | 11/2009 |
| JP | 2010-128336 | A | 6/2010 |
| JP | 2010-175619 | A | 8/2010 |
| JP | 2011-13268 | A | 1/2011 |
| JP | 2011-075644 | A | 4/2011 |
| JP | 2011-075650 | A | 4/2011 |
| JP | 2011-190102 | A | 9/2011 |
| JP | 2012-123188 | A | 6/2012 |
| JP | 2014-186195 | A | 10/2014 |
| JP | 2014-186286 | A | 10/2014 |

OTHER PUBLICATIONS

International Preliminary Report on Patentability issued in corresponding International Patent Application No. PCT/JP2018/013533, dated Feb. 13, 2020.

* cited by examiner

DRUM UNIT HAVING ELECTRICAL CONTACT SURFACE POSITIONED AT OUTER SURFACE OF FRAME AND IMAGE FORMING APPARATUS PROVIDED WITH THE SAME

CROSS REFERENCE TO RELATED APPLICATION

This application is a continuation of U.S. patent application Ser. No. 15/941,182, filed Mar. 30, 2018, which further claims priority from Japanese Patent Application No. 2017-149329 filed Aug. 1, 2017. The entire contents of both applications are incorporated herein by reference. The present application is closely related to the co-pending U.S. Patent Application corresponding to Japanese Patent Application No. 2017-149328 filed Aug. 1, 2017.

TECHNICAL FIELD

The present disclosure relates to a drum unit, and an image forming apparatus provided with the same.

BACKGROUND

Conventionally, an electro-photographic type image forming apparatus such as a laser printer and an LED printer is known in the art. The image forming apparatus includes a drum unit. The drum unit includes a plurality of photosensitive drums. A plurality of developing cartridges is detachably attachable to the drum unit. When a developing cartridge is attached to the drum unit, a developing roller provided in the developing cartridge contacts a corresponding photosensitive drum provided in the drum unit.

Japanese Patent Application Publication No. 2010-128336 discloses such an image forming apparatus including a drum unit.

SUMMARY

A developing cartridge including a storage medium is also well known in the art. The storage medium stores various information relating to the developing cartridge. In recent years, a large amount of information is handled not only for the developing cartridges, but also for drum units. Consequently, it is demanded that a storage medium is mounted on a drum unit. When a storage medium is mounted on a drum unit, an electrical contact surface of the storage medium must contact an electrical contact of the image forming apparatus in a state where the drum unit is attached to a main casing of the image forming apparatus.

In view of the foregoing, it is an object of the present disclosure to provide a drum unit including a storage medium whose electrical contact surface is capable of contacting an external electrical contact.

In order to attain the above and other objects, according to one aspect, the disclosure provides a drum unit including: a frame; a first photosensitive drum; a second photosensitive drum; a charger; and a storage medium. The frame includes: a first frame plate; a second frame; and a third frame plate; and a fourth frame plate. The second frame plate is spaced apart from the first frame plate in a first direction. The first frame plate has one end and another end in a second direction crossing the first direction and the second frame plate has one end and another end in the second direction. The third frame plate extends in the first direction and connects the one end of the first frame plate to the one end of the second frame plate. The fourth frame plate extends in the first direction and connects the another end of the first frame plate to the another end of the second frame plate. The fourth frame plate is spaced apart from the third frame plate in the second direction. The first photosensitive drum is rotatably supported by the first frame plate and the second frame plate about a first axis extending in the first direction. The second photosensitive drum is rotatably supported by the first frame plate and the second frame plate about a second axis extending in the first direction. The second photosensitive drum is spaced apart from the first photosensitive drum in the second direction and is positioned closer to the third frame plate than the first photosensitive drum is to the third frame plate in the second direction. The charger is positioned between the first axis and the second axis in the second direction. The charger is configured to charge an outer circumferential surface of the first photosensitive drum. The storage medium has an electrical contact surface positioned at an outer surface of the fourth frame plate.

According to another aspect, the disclosure provides an image forming apparatus including: a drum unit; and a casing. The drum unit includes: a frame; a first photosensitive drum; a second photosensitive drum; a charger; and a storage medium. The frame includes: a first frame plate; a second frame; and a third frame plate; and a fourth frame plate. The second frame plate is spaced apart from the first frame plate in a first direction. The first frame plate has one end and another end in a second direction crossing the first direction and the second frame plate has one end and another end in the second direction. The third frame plate extends in the first direction and connects the one end of the first frame plate to the one end of the second frame plate. The fourth frame plate extends in the first direction and connects the another end of the first frame plate to the another end of the second frame plate. The fourth frame plate is spaced apart from the third frame plate in the second direction. The first photosensitive drum is rotatably supported by the first frame plate and the second frame plate about a first axis extending in the first direction. The second photosensitive drum is rotatably supported by the first frame plate and the second frame plate about a second axis extending in the first direction. The second photosensitive drum is spaced apart from the first photosensitive drum in the second direction and is positioned closer to the third frame plate than the first photosensitive drum is to the third frame plate in the second direction. The charger is positioned between the first axis and the second axis in the second direction. The charger is configured to charge an outer circumferential surface of the first photosensitive drum. The storage medium has an electrical contact surface positioned at an outer surface of the fourth frame plate. The casing has an internal space therein for accommodating the drum unit.

According to still another aspect, the disclosure provides a drum unit configured to be inserted into a casing of an image forming apparatus in an insertion direction. The drum unit includes: a frame; a first photosensitive drum; a second photosensitive drum; and a storage medium. The frame includes: a first frame plate; a second frame plate; a third frame plate; and a fourth frame plate. The first frame plate has an upstream end and a downstream end in the insertion direction. The second frame plate is spaced apart from the first frame plate in a lateral direction crossing the insertion direction. The second frame plate has an upstream end and a downstream end in the insertion direction. The third frame plate extends in the lateral direction and connects the downstream end of the first frame plate to the downstream end of the second frame plate. The fourth frame plate extends in the lateral direction and connects the upstream end of the first frame plate to the upstream end of the second frame plate. The fourth frame plate is spaced apart from the third frame plate in the insertion direction. The first photosensitive drum is rotatably supported by the first frame plate and the second frame plate about a first axis extending in the lateral direction. The second photosensitive drum is rotatably supported by the first frame plate and the second frame plate about a second axis extending in the lateral direction. The second photosensitive drum is positioned downstream of the first photosensitive drum in the insertion direction. The storage medium has an electrical contact surface positioned at an outer surface of the fourth frame plate.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
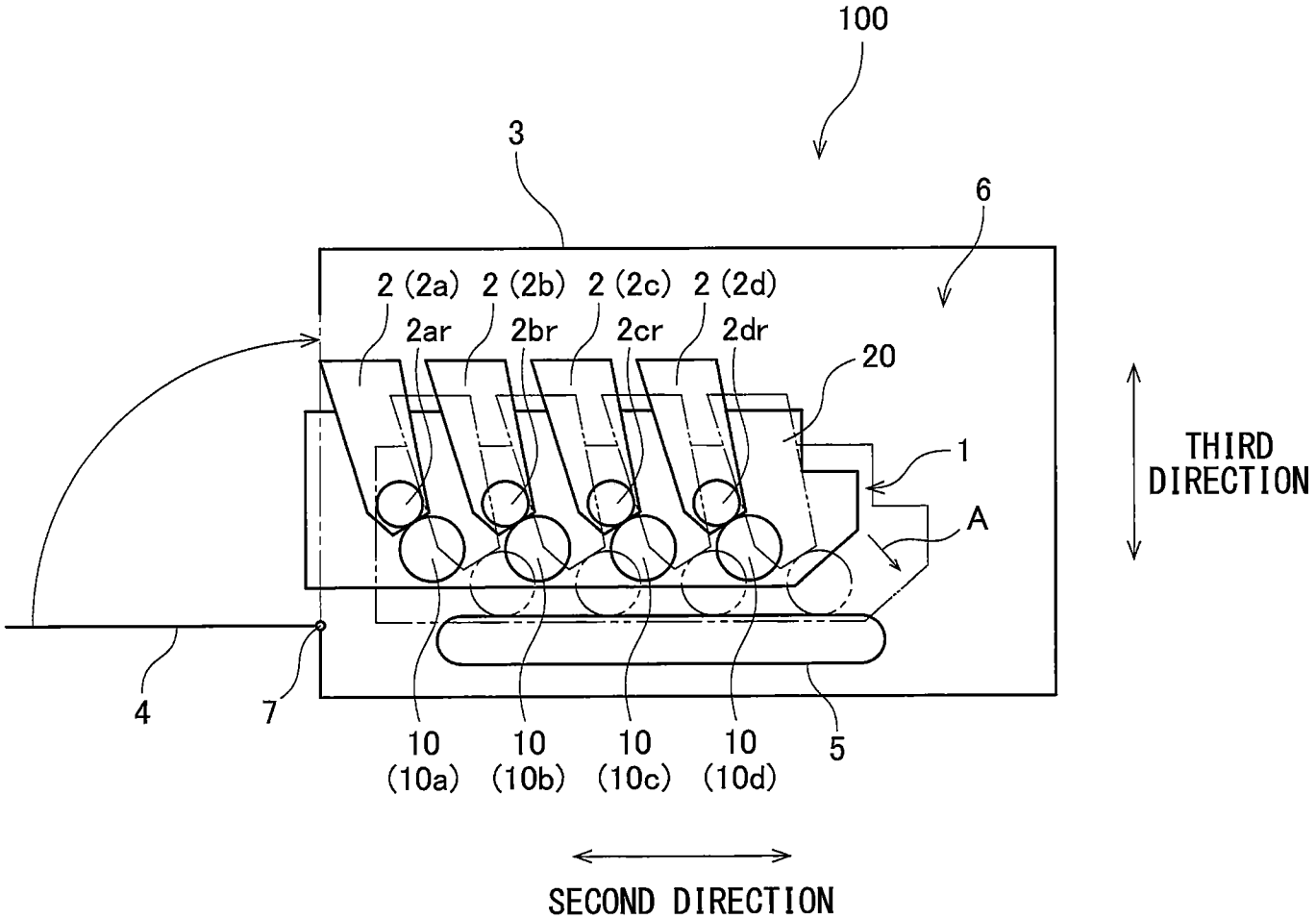
FIG. 1 is a schematic diagram of an image forming apparatus according to one embodiment of the present disclosure.

An image forming apparatus 100 including a drum unit 1 according to one embodiment of the present disclosure will be described with reference to FIGS. 1 through 7.

In the following description, a direction in which axes of photosensitive drums 10 extend will be referred to as a "first direction" (an example of a lateral direction); a direction in which the photosensitive drums 10 are arrayed will be referred to as a "second direction"; and a direction in which the drum unit 1 and a transfer belt 5 of the image forming apparatus 100 are arrayed in a state where the drum unit 1 is in an attached position will be referred to as a "third direction." The first direction and the second direction are crossing each other (preferably, perpendicular to each other). The second direction and the third direction are crossing each other (preferably, perpendicular to each other). The third direction and the first direction are crossing each other (preferably, perpendicular to each other).

<1. Structure of Image Forming Apparatus>

FIG. 1 is a schematic diagram of the image forming apparatus 100. The image forming apparatus 100 is an electro-photographic type image forming apparatus such as a laser printer and an LED printer. As illustrated in FIG. 1, the image forming apparatus 100 includes the drum unit 1, four developing cartridges 2, a casing 3, a cover 4, and the transfer belt 5. The drum unit 1 is configured to hold the four developing cartridges 2. The four developing cartridges 2 are respectively detachably attachable to a frame 20 of the drum unit 1. The casing 3 has an interior space 6. The drum unit 1 is configured to be accommodated within the interior space 6 of the casing 3 in a state where the drum unit 1 holds the four developing cartridges 2.

The image forming apparatus 100 is configured to record images on recording surfaces of printing papers using developer (toner, for example) supplied from the four developing cartridges 2.

The four developing cartridges 2 include a first developing cartridge 2*a*, a second developing cartridge 2*b*, a third developing cartridge 2*c*, and a fourth developing cartridge 2*d*. The first developing cartridge 2*a*, the second developing cartridge 2*b*, the third developing cartridge 2*c*, and the fourth developing cartridge 2*d* are configured to supply developer of different colors.

The first developing cartridge 2*a* includes a first developing roller 2*ar*. The second developing cartridge 2*b* includes a second developing roller 2*br*. The third developing cartridge 2*c* includes a third developing roller 2*cr*. The fourth developing cartridge 2*d* includes a fourth developing roller 2*dr*. Each of the first developing roller 2*ar*, the second developing roller 2*br*, the third developing roller 2*cr*, and the fourth developing roller 2*dr* has a hollow cylindrical shape, and has an outer circumferential surface centered on an axis extending in the first direction. Each of the first developing roller 2*ar*, the second developing roller 2*br*, the third developing roller 2*cr*, and the fourth developing roller 2*dr* is rotatable about the axis extending in the first direction.

The drum unit 1 includes four photosensitive drums 10. Specifically, the drum unit 1 includes a first photosensitive drum 10*a*, a second photosensitive drum 10*b*, a third photosensitive drum 10*c*, and a fourth photosensitive drum 10*d*. Each of the first photosensitive drum 10*a*, the second photosensitive drum 10*b*, the third photosensitive drum 10*c*, and the fourth photosensitive drum 10*d* has a hollow cylindrically shape, and has an outer circumferential surface centered on a center axis extending in the first direction. Further, each of the first photosensitive drum 10*a*, the second photosensitive drum 10*b*, the third photosensitive drum 10*c*, and the fourth photosensitive drum 10*d* is rotatable about the axis extending in the first direction.

When the four developing cartridges 2 are attached to the drum unit 1, the outer circumferential surface of the first developing roller 2*ar* contacts the outer circumferential surface of the first photosensitive drum 10*a*; the outer circumferential surface of the second developing roller 2*br* contacts the outer circumferential surface of the second photosensitive drum 10*b*; the outer circumferential surface of the third developing roller 2*cr* contacts the outer circumferential surface of the third photosensitive drum 10*c*; and the outer circumferential surface of the fourth developing roller 2*dr* contacts the outer circumferential surface of the fourth photosensitive drum 10*d*.

The cover 4 is movable between an open position indicated by a solid line in FIG. 1, and a closed position indicated by a two-dotted chain line in FIG. 1. More specifically, the cover 4 is pivotally movable about an axis of a pivot shaft 7 extending in the first direction. When the cover 4 is in the open position, the interior space 6 of the casing 3 is exposed to the outside. On the other hand, when the cover 4 is in the closed position, the interior space 6 of the casing 3 is closed.

While the cover 4 is in the open position, a user of the image forming apparatus 100 can move the drum unit 1 between a withdrawn position and the attached position via an intermediate position in a state where the four developing cartridges 2 are attached to the drum unit 1. The drum unit 1 in the withdrawn position is positioned outside the casing 3. The drum unit 1 in the attached position is accommodated in the interior space 6 of the casing 3.

In order to attach the drum unit 1 to the image forming apparatus 100, the user first moves the cover 4 to the open position. Next, the user inserts the drum unit 1 into the interior space 6 of the casing 3 in the second direction in a state where the four developing cartridges 2 are attached to the drum unit 1. Accordingly, the drum unit moves from the withdrawn position to the intermediate position. In a state where the drum unit 1 is in the intermediate position, the drum unit 1 faces the transfer belt 5 in the third direction. Subsequently, the user moves the cover 4 from the open position to the closed position.

In accordance with movement of the cover 4 from the open position to the closed position, the drum unit 1 is moved from the intermediate position to the attached position. The drum unit 1 in the attached position is closer to the transfer belt 5 than the drum unit 1 in the intermediate position is to the transfer belt 5. At this time, the drum unit 1 is moved in a fourth direction indicated by an arrow A in FIG. 1. The fourth direction is inclined relative to the second direction and the third direction. More specifically, the fourth direction is a direction in which the first developing roller 2*ar* and the first photosensitive drum 10*a* are arranged in a state where the first developing cartridge 2*a* is attached to the frame 20 of the drum unit 1.

The transfer belt 5 is an annular belt configured to convey printing papers. In a state where the drum unit 1 is in the attached position, the transfer belt 5 is positioned at a first side of the four photosensitive drums 10 in the third direction illustrated in FIG. 1. In other words, the transfer belt 5 faces the four photosensitive drums 10 in the third direction in a state where the drum unit 1 is in the attached position.

Hereinafter, a distance between the outer circumferential surface of the first photosensitive drum 10*a* and an outer circumferential surface of the transfer belt 5 prior to movement of the drum unit 1 in the fourth direction (that is, a distance between the outer circumferential surface of the first photosensitive drum 10*a* of the drum unit 1 in the intermediate position and the outer circumferential surface of the transfer belt 5) will be referred to as a first distance, and a distance between the outer circumferential surface of the first photosensitive drum 10*a* and the outer circumferential surface of the transfer belt 5 after the drum unit 1 has been moved in the fourth direction (that is, a distance between the outer circumferential surface of the first photosensitive drum 10*a* of the drum unit 1 in the attached position and the outer circumferential surface of the transfer belt 5) will be referred to as a second distance. The first distance is greater than the second distance. Hence, as the drum unit 1 is moved in the fourth direction, the four photosensitive drums 10 approach the transfer belt 5. In a state where the drum unit 1 is in the attached position, the outer circumferential surfaces of the four photosensitive drums 10 are in contact with the outer circumferential surface of the transfer belt 5.

<2. Structure of Drum Unit>

Figure 2:
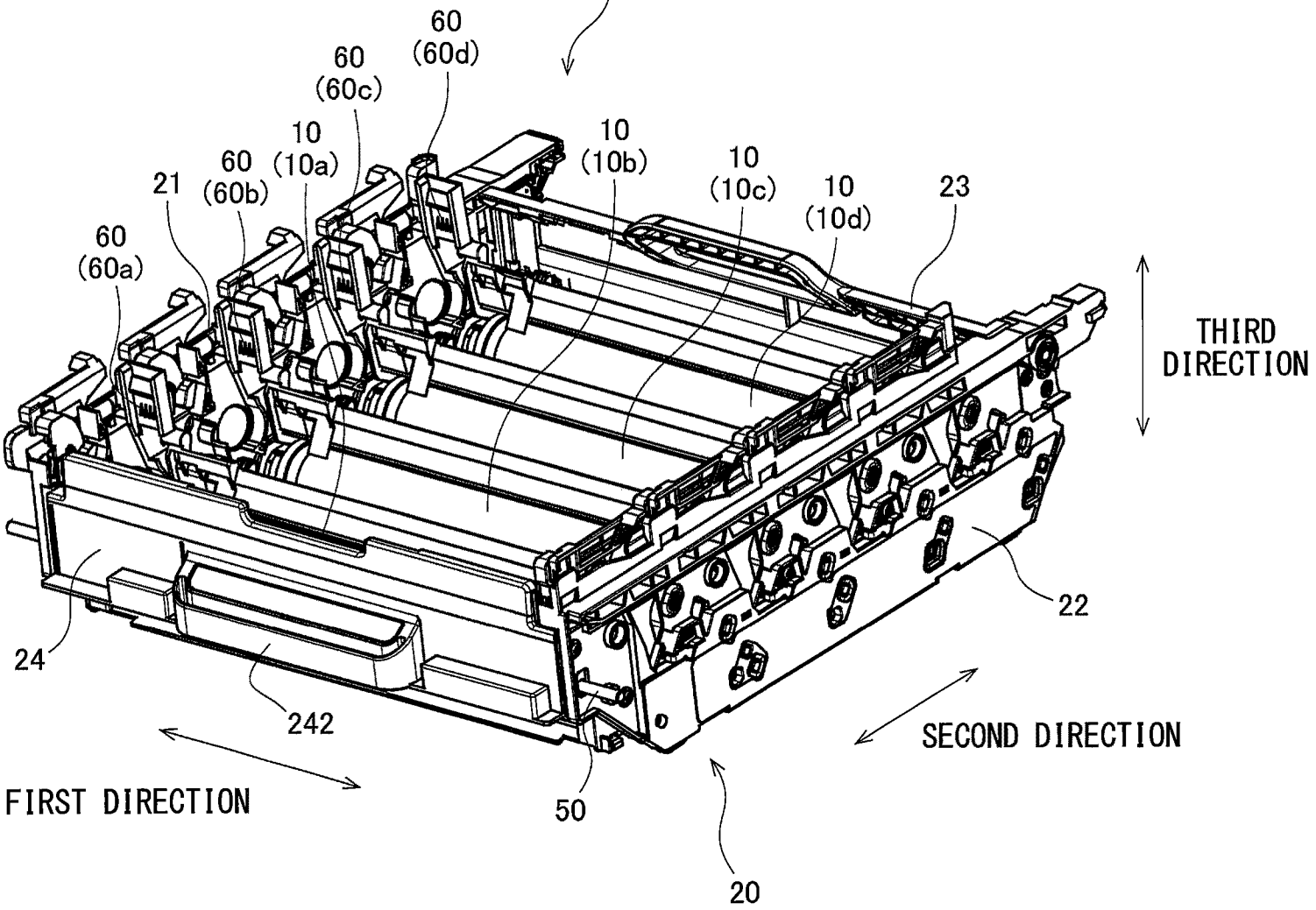
FIG. 2 is a perspective view of a drum unit according to the embodiment.
Figure 3:
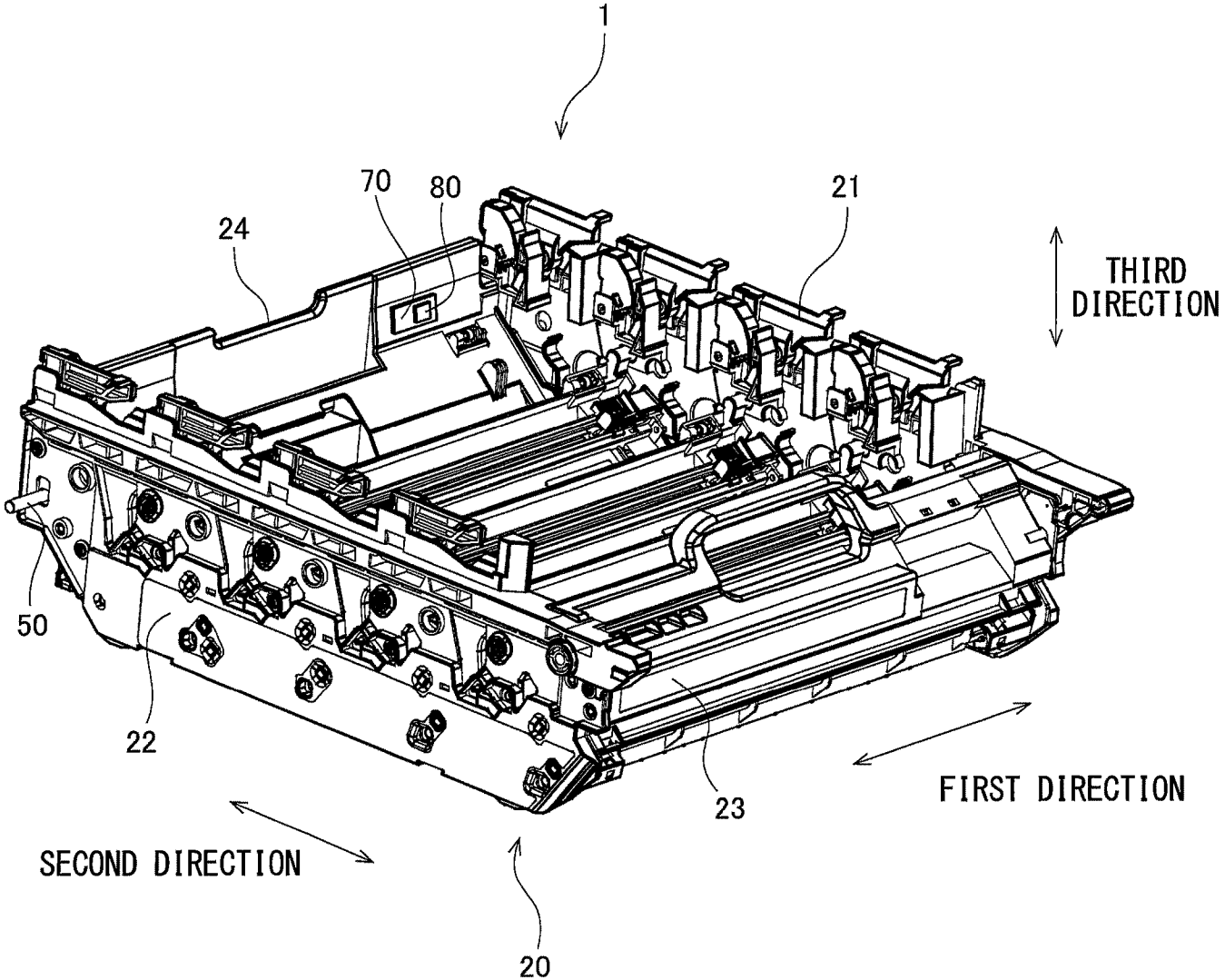
FIG. 3 is another perspective view of the drum unit according to the embodiment.
Figure 4:
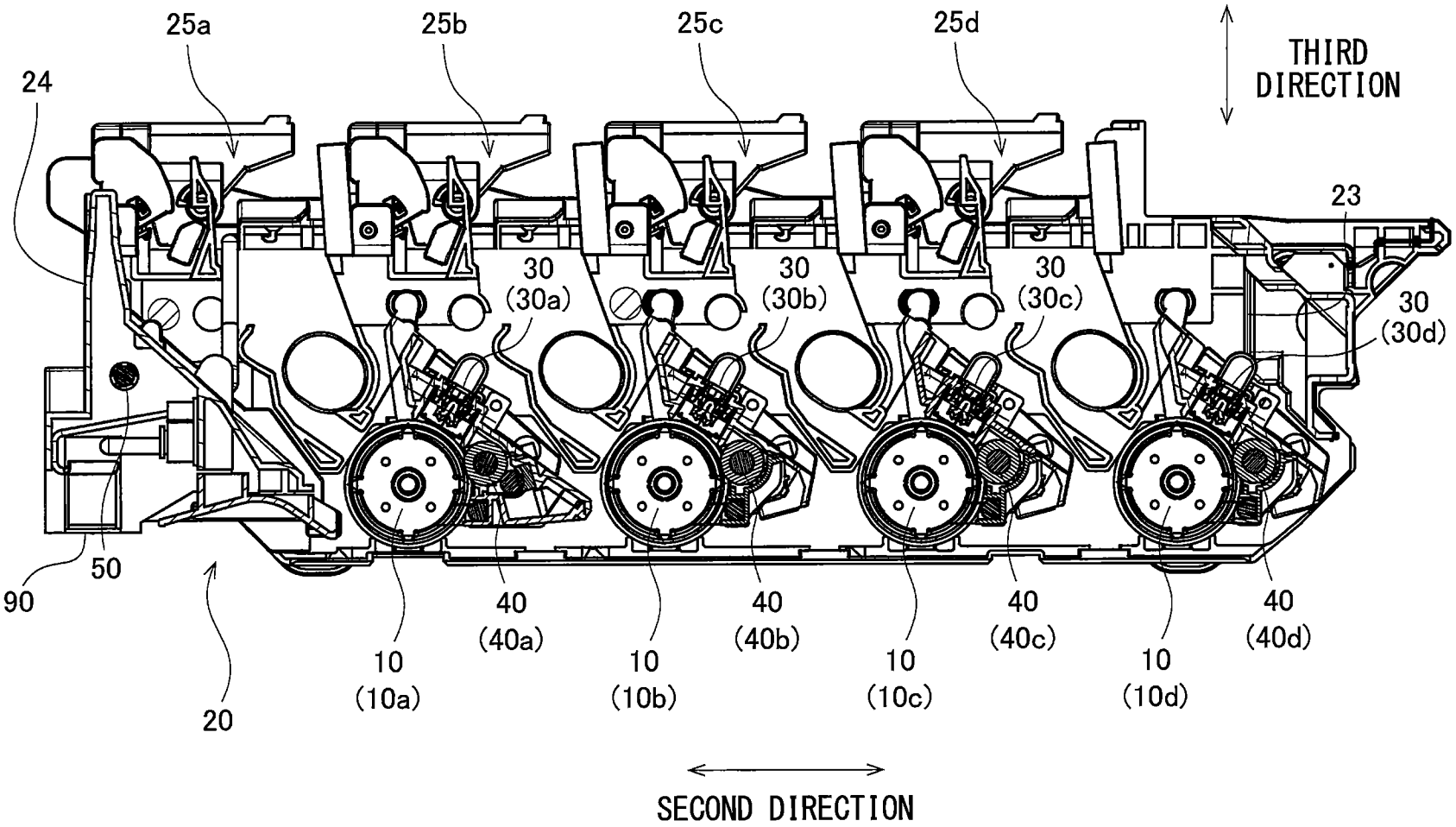
FIG. 4 is a cross-sectional view of the drum unit according to the embodiment.

Next, a structure of the drum unit 1 will be described in greater detail. FIGS. 2 and 3 are perspective views of the drum unit 1. FIG. 4 is a cross-sectional view of the drum unit 1 taken along a plane perpendicular to the first direction.

As illustrated in FIGS. 2 through 4, the drum unit 1 includes the four photosensitive drums 10, the frame 20, four chargers 30, four cleaning members 40, a shaft 50, four electrical terminals 60, a relay board 70, and an IC chip 80 (an example of a memory).

The photosensitive drums 10 are configured to transfer developer supplied from the corresponding developing cartridges 2 onto printing papers. As described above, the drum unit 1 includes the four photosensitive drums 10 including the first photosensitive drum 10*a*, the second photosensitive drum 10*b*, the third photosensitive drum 10*c*, and the fourth photosensitive drum 10*d*. The first photosensitive drum 10*a*, the second photosensitive drum 10*b*, the third photosensitive drum 10*c*, and the fourth photosensitive drum 10*d* are arranged spaced apart from one another at intervals in the second direction. The first photosensitive drum 10*a* is rotatable about a first axis extending in the first direction. The second photosensitive drum 10*b* is rotatable about a second axis extending in the first direction. The third photosensitive drum 10*c* is rotatable about a third axis extending in the first direction. The fourth photosensitive drum 10*d* is rotatable about a fourth axis extending in the first direction.

The second photosensitive drum 10*b* is positioned downstream of the first photosensitive drum 10*a* in a direction in which the drum unit 1 is inserted into the casing 3 of the image forming apparatus 100 (the second direction in the present embodiment). Similarly, the third photosensitive drum 10*c* is positioned downstream of the second photosensitive drum 10*b* in the insertion direction of the drum unit 1, and the fourth photosensitive drum 10*d* is positioned downstream of the third photosensitive drum 10*c* in the insertion direction of the drum unit 1.

The frame 20 is a frame that holds the four photosensitive drums 10. The frame 20 includes a first frame plate 21, a second frame plate 22, a third frame plate 23, and a fourth frame plate 24. The first frame plate 21 is positioned at a first side of the four photosensitive drums 10 in the first direction. The first frame plate 21 expands perpendicularly to the first direction and is elongated in the second direction. The second frame plate 22 is positioned at a second side of the four photosensitive drums 10 in the first direction. The second frame plate 22 expands perpendicularly to the first direction and is elongated in the second direction. That is, the first frame plate 21 and the second frame plate 22 faces each other in the first direction with the four photosensitive drums 10 interposed therebetween. The four photosensitive drum 10 are rotatably supported by the first frame plate 21 and the second frame plate 22.

The third frame plate 23 is positioned at the first side of the four photosensitive drums 10 in the second direction (the downstream side in the insertion direction). The third frame plate 23 extends in the first direction. The third frame plate 23 connects one end of the first side of the first frame plate 21 in the second direction to one end of the first side of the second frame plate 22 in the second direction. The fourth frame plate 24 is positioned at a second side of the photosensitive drums 10 in the second direction (the upstream side in the insertion direction). The fourth frame plate 24 extends in the first direction. The fourth frame plate 24 connects one end of the second side of the first frame plate 21 in the second direction to one end of the second side of the second frame plate 22 in the second direction.

As illustrated in FIG. 4, the frame 20 has a first opening 25*a*, a second opening 25*b*, a third opening 25*c*, and a fourth opening 25*d*. The first opening 25*a* is communicated in the fourth direction with a space at which the first photosensitive drum 10*a* is positioned. When the first developing cartridge 2*a* is attached to the frame 20, the first developing roller 2*ar* of the first developing cartridge 2*a* passes through the first opening 25*a* and is inserted into the space toward the first photosensitive drum 10*a*. The second opening 25*b* is communicated in the fourth direction with a space at which the second photosensitive drum 10*b* is positioned. When the second developing cartridge 2*b* is attached to the frame 20, the second developing roller 2*br* of the second developing cartridge 2*b* passes through the second opening 25*b* and is inserted into the space toward the second photosensitive drum 10*b*.

The third opening 25*c* is communicated in the fourth direction with a space at which the third photosensitive drum 10*c* is positioned. When the third developing cartridge 2*c* is attached to the frame 20, the third developing roller 2*cr* of the third developing cartridge 2*c* passes through the third opening 25*c* and is inserted into the space toward the third photosensitive drum 10*c*. The fourth opening 25*d* is communicated in the fourth direction with a space at which the fourth photosensitive drum 10*d* is positioned. When the fourth developing cartridge 2*d* is attached to the frame 20, the fourth developing roller 2*dr* of the fourth developing cartridge 2*d* passes through the fourth opening 25*d* and is inserted into the space toward the fourth photosensitive drum 10*d*.

The third frame plate 23 is positioned opposite to a first cleaning member 40*a* (described later) with respect to the second photosensitive drum 10*b* in the second direction. The fourth frame plate 24 is positioned opposite to the first cleaning member 40*a* with respect to the first photosensitive drum 10*a* in the second direction. The third frame plate 23 is positioned opposite to the first photosensitive drum 10*a* with respect to the second opening 25*b* in the second direction. The fourth frame plate 24 is positioned opposite to the first photosensitive drum 10*a* with respect to the first opening 25*a* in the second direction. The third frame plate 23 has an outer surface positioned opposite to the shaft 50 (described later) with respect to the first photosensitive drum 10*a* in the second direction. The fourth frame plate 24 has an outer surface positioned opposite to the first photosensitive drum 10*a* with respect to the shaft 50 in the second direction.

The chargers 30 are configured to charge the outer circumferential surfaces of the corresponding photosensitive drums 10 in accordance with the image to be printed. The drum unit 1 includes four chargers 30, namely, a first charger 30*a*, a second charger 30*b*, a third charger 30*c*, and a fourth charger 30*d*. The first charge 30*a* is positioned between the first axis of the first photosensitive drum 10*a* and the second axis of the second photosensitive drum 10*b* in the second direction. The first charger 30*a* is configured to charge the outer circumferential surface of the first photosensitive drum 10*a* from the first side of the first axis in the second direction. The second charger 30*b* is positioned between the second axis of the second photosensitive drum 10*b* and the third axis of the third photosensitive drum 10*c* in the second direction. The second charger 30*b* is configured to charge the outer circumferential surface of the second photosensitive drum 10*b* from the first side of the second axis in the second direction. The third charger 30*c* is positioned between the third axis of the third photosensitive drum 10*c* and the fourth axis of the fourth photosensitive drum 10*d* in the second direction. The third charger 30*c* is configured to charge the outer circumferential surface of the third photosensitive drum 10*c* from the first side of the third axis in the second direction. The fourth charger 30*d* is positioned between the fourth axis of the fourth photosensitive drum 10*d* and the third frame plate 23 in the second direction. The fourth charger 30*d* is configured to charge the outer circumferential surface of the fourth photosensitive drum 10*d* from the first side of the fourth axis in the second direction.

In the present embodiment, the chargers 30 have scorotron chargers. However, instead of scorotron chargers, the chargers 30 may have another type of charging means, such as charging rollers.

The cleaning members 40 are configured to remove developer adhering to the outer circumferential surfaces of the corresponding photosensitive drums 10. The drum unit 1 includes four cleaning members 40 including the first cleaning member 40*a*, a second cleaning member 40*b*, a third cleaning member 40*c*, and a fourth cleaning member 40*d*.

The first cleaning member 40*a* is positioned between the first photosensitive drum 10*a* and the second photosensitive drum 10*b* (that is, between the first axis and the second axis) in the second direction. The first cleaning member 40*a* is in contact with the outer circumferential surface of the first photosensitive drum 10*a* to remove developer therefrom. The second cleaning member 40*b* is positioned between the second photosensitive drum 10*b* and the third photosensitive drum 10*c* (that is, between the second axis and the third axis) in the second direction. The second cleaning member 40*b* is in contact with the outer circumferential surface of the second photosensitive drum 10*b* to remove developer therefrom. The third cleaning member 40*c* is positioned between the third photosensitive drum 10*c* and the fourth photosensitive drum 10*d* (that is, between the third axis and the fourth axis) in the second direction. The third cleaning member 40*c* is in contact with the outer circumferential surface of the third photosensitive drum 10*c* to remove developer therefrom. The fourth cleaning member 40*d* is positioned at the first side of the fourth photosensitive drum 10*d* (that is, between the fourth axis and the third frame plate 23) in the second direction. The fourth cleaning member 40*d* is in contact with the outer circumferential surface of the fourth photosensitive drum 10*d* to remove developer therefrom.

In the present embodiment, the cleaning members 40 have the cleaning rollers. However, instead of cleaning rollers, the cleaning members 40 may have another type of cleaning means, such as cleaning blades.

The shaft 50 functions to fix the drum unit 1 in the attached position relative to the casing 3 when the drum unit 1 is accommodated in the interior space 6 of the casing 3. The shaft 50 is positioned at the second side of the first photosensitive drum 10*a* in the second direction. In other words, the shaft 50 is positioned between the fourth frame plate 24 and the first photosensitive drum 10*a* in the second direction. The shaft 50 extends in the first direction. One end of the shaft 50 in the first direction is positioned opposite to the second frame plate 22 relative to the first frame plate 21. Another end of the shaft 50 in the first direction is positioned opposite to the first frame plate 21 relative to the second frame plate 22. That is, the shaft 50 penetrates the first frame plate 21 and the second frame plate 22 in the first direction.

When the drum unit 1 is accommodated in the interior space 6 of the casing 3, both ends of the shaft 50 in the first direction contact portions of the casing 3. With this configuration, the shaft 50 is fixed in position relative to the casing 3. Accordingly, the drum unit 1 is fixed in position relative to the casing 3.

The electrical terminals 60 are conductors. The electrical terminals 60 are configured to be electrically connected to IC chips of the developing cartridges 2. One electrical terminal 60 is provided for each photosensitive drum 10. That is, the drum unit 1 includes four electrical terminals 60, including a first electrical terminal 60*a*, a second electrical terminal 60*b*, a third electrical terminal 60*c*, and a fourth electrical terminal 60*d*. Four electrical terminals 60 are positioned between the first frame plate 21 and the second frame plate 22 in the first direction. Further, electrical terminals 60 are positioned between the third frame plate 23 and the fourth frame plate 24 in the second direction.

When the first developing cartridge 2*a* is attached to the drum unit 1, the first electrical terminal 60*a* contacts an electrical contact surface of the IC chip of the first developing cartridge 2*a*. When the second developing cartridge 2*b* is attached to the drum unit 1, the second electrical terminal 60*b* contacts an electrical contact surface of the IC chip of the second developing cartridge 2*b*. When the third developing cartridge 2*c* is attached to the drum unit 1, the third electrical terminal 60*c* contacts an electrical contact surface of the IC chip of the third developing cartridge 2*c*. When the fourth developing cartridge 2*d* is attached to the drum unit 1, the fourth electrical terminal 60*d* contacts an electrical contact surface of the IC chip of the fourth developing cartridge 2*d*.

The relay board 70 is a circuit board. The relay board 70 is configured to electrically connect the four electrical terminals 60, the IC chip 80 (described later), and a plurality of electrical contact surfaces 90 (described later) to each other. As illustrated in FIG. 3, the relay board 70 is positioned at an inner surface of the fourth frame plate 24 (i.e., the surface of the fourth frame plate 24 facing the third frame plate 23 in the second direction). The relay board 70 is electrically connected to each of the first electrical terminal 60*a*, the second electrical terminal 60*b*, the third electrical terminal 60*c*, the fourth electrical terminal 60*d*, the IC chip 80, and the electrical contact surfaces 90 through a wire (not illustrated).

The IC chip 80 is a small integrated circuit including memory. As illustrated in FIG. 3, the IC chip 80 is fixed to a surface of the relay board 70 in the second direction. In other words, the IC chip 80 is positioned at a surface of the relay board 70 facing the third frame plate 23 in the second direction. However, the IC chip 80 may be positioned at another position in the drum unit 1. The memory on the IC chip 80 stores various information relating to the drum unit 1. For example, the memory may store information on the expected service life of the photosensitive drums 10.

<3. Electrical Contact Surfaces>

As described above, the drum unit 1 includes the plurality of electrical contact surfaces 90. The electrical contact surfaces 90 are conductive metal. The electrical contact surfaces 90 are fixed to the third frame plate 23 either directly or through other components. When the drum unit 1 is attached to the casing 3 of the image forming apparatus 100, the electrical contact surfaces 90 contact electrical contacts of the image forming apparatus 100. Next, the electrical contact surfaces 90 will be described in greater detail.

Figure 5:
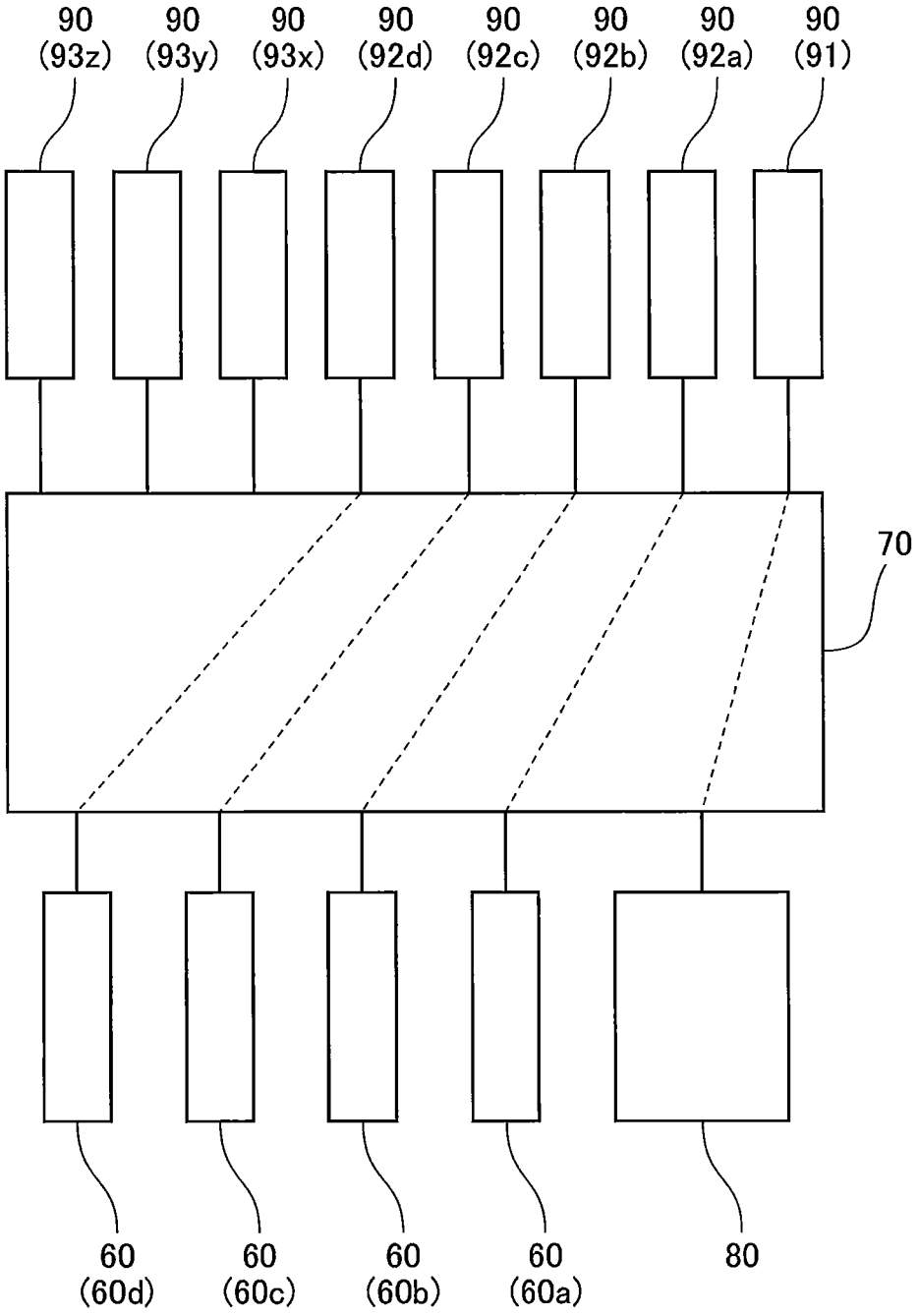
FIG. 5 is a block diagram illustrating electrical connection relationship among four electrical terminals, an IC chip, and eight electrical contact surfaces in the drum unit according to the embodiment.

FIG. 5 is a block diagram illustrating relationships of electrical connections among the four electrical terminals 60, the IC chip 80, and the eight electrical contact surfaces 90. As illustrated in FIG. 5, the drum unit 1 according to the present embodiment has one first electrical contact surface 91; four second electrical contact surfaces 92*a*, 92*b*, 92*c*, and 92*d*; and three third electrical contact surfaces 93*x*, 93*y*, and 93*z* for a total of eight electrical contact surfaces 90. The IC chip 80 and the electrical contact surface 90 constitute an example of a storage medium in the present disclosure The first electrical contact surface 91 is electrically connected to the IC chip 80 through the relay board 70. The first electrical contact surface 91 is an electrode for inputting information into and outputting information from the IC chip 80. That is, the IC chip 80 is configured to receive inputted electrical signals specifying information and outputs electrical signals specifying information through the first electrical contact surface 91.

The second electrical contact surface 92*a* is electrically connected to the first electrical terminal 60*a* through the relay board 70. The second electrical contact surface 92*a* is an electrode for inputting information into and outputting information from the IC chip on the first developing cartridge 2*a* in contact with the first electrical terminal 60*a*. The second electrical contact surface 92*b* is electrically connected to the second electrical terminal 60*b* through the relay board 70. The second electrical contact surface 92*b* is an electrode that inputs information into and outputs information from the IC chip on the second developing cartridge 2*b* in contact with the second electrical terminal 60*b*. The second electrical contact surface 92*c* is electrically connected to the third electrical terminal 60*c* through the relay board 70. The second electrical contact surface 92*c* is an electrode that inputs information into and outputs information from the IC chip on the third developing cartridge 2*c* in contact with the third electrical terminal 60*c*. The second electrical contact surface 92*d* is electrically connected to the fourth electrical terminal 60*d* through the relay board 70. The second electrical contact surface 92*d* is an electrode for inputting information into and outputting information from the IC chip on the fourth developing cartridge 2*d* in contact with the fourth electrical terminal 60*d*.

The third electrical contact surface 93*x* is electrically connected to the IC chip 80, the first electrical terminal 60*a*, the second electrical terminal 60*b*, the third electrical terminal 60*c*, and the fourth electrical terminal 60*d* through the relay board 70. The third electrical contact surface 93*x* is an electrode configured to supply electric power to the IC chip 80, the first electrical terminal 60*a*, the second electrical terminal 60*b*, the third electrical terminal 60*c*, and the fourth electrical terminal 60*d*. The third electrical contact surface 93*y* is electrically connected to the IC chip 80, the first electrical terminal 60*a*, the second electrical terminal 60*b*, the third electrical terminal 60*c*, and the fourth electrical terminal 60*d* through the relay board 70. The third electrical contact surface 93*y* is an electrode for outputting a clock signal to the IC chip 80, the first electrical terminal 60*a*, the second electrical terminal 60*b*, the third electrical terminal 60*c*, and the fourth electrical terminal 60*d*. The third electrical contact surface 93*z* is electrically connected to the IC chip 80, the first electrical terminal 60*a*, the second electrical terminal 60*b*, the third electrical terminal 60*c*, and the fourth electrical terminal 60*d* through the relay board 70. The third electrical contact surface 93*z* is an electrode that supplies a ground voltage to the IC chip 80, the first electrical terminal 60*a*, the second electrical terminal 60*b*, the third electrical terminal 60*c*, and the fourth electrical terminal 60*d*.

These electrical contact surfaces 90 are arranged spaced apart from each other in the first direction or in the second direction, for example. However, the order in which the eight electrical contact surfaces 90 are arranged is not limited to that illustrated in FIG. 5.

Figure 6:
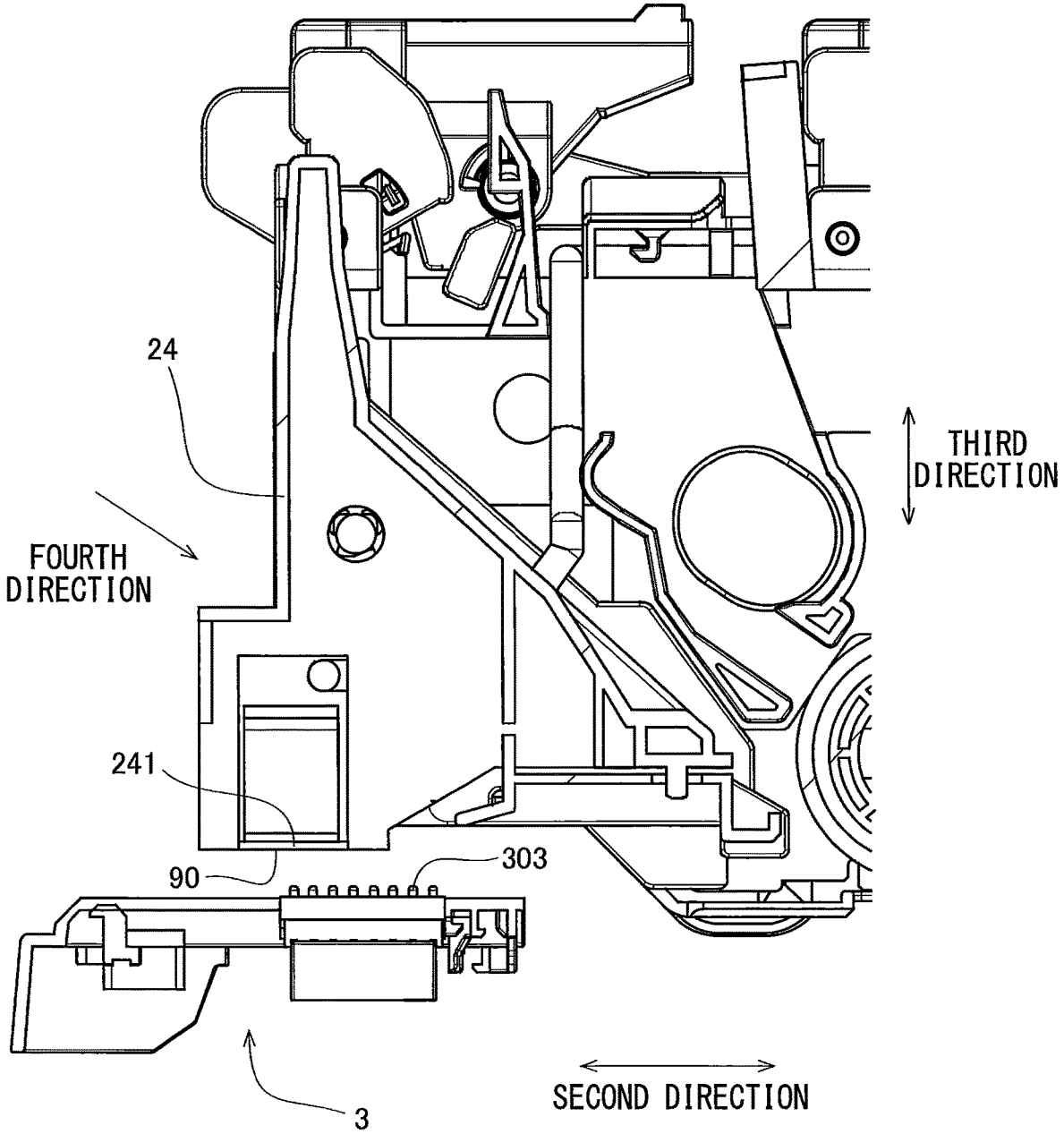
FIG. 6 is a partial cross-sectional view of the image forming apparatus according to the embodiment, particularly illustrating a portion adjacent to the electrical contact surfaces.
Figure 7:
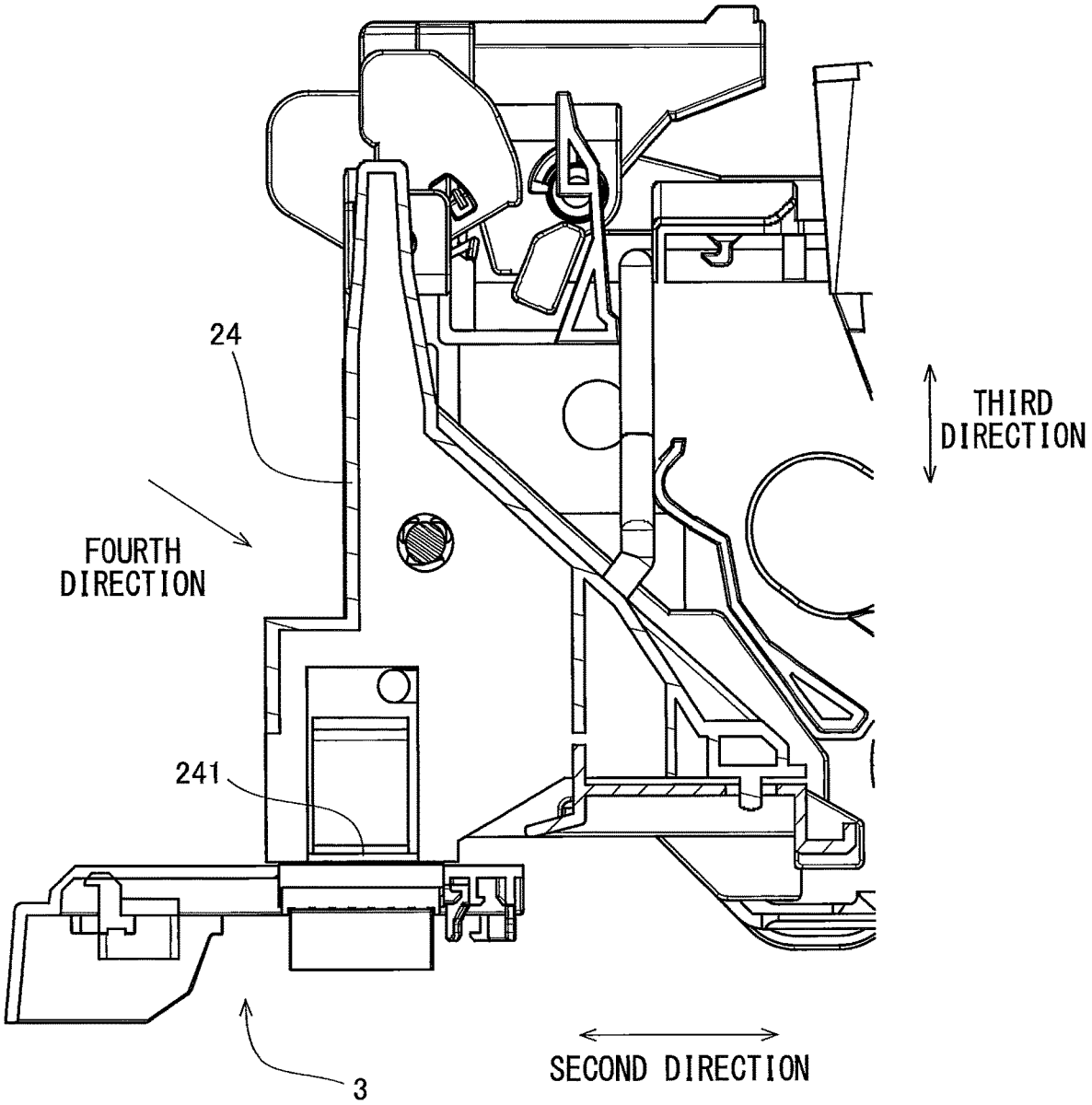
FIG. 7 is another partial cross-sectional view of the image forming apparatus according to the embodiment, particularly illustrating the portion adjacent to the electrical contact surfaces.

FIGS. 6 and 7 are partial cross-sectional views of the image forming apparatus 100 illustrating a portion in the vicinity of the electrical contact surfaces 90. FIG. 6 illustrates a state in which the electrical contact surfaces 90 are not contacting electrical contacts 303 (an example of a device-side contact) in the image forming apparatus 100. FIG. 7 illustrates a state in which the electrical contact surfaces 90 are contacting the electrical contacts 303 in the image forming apparatus 100.

As illustrated in FIGS. 6 and 7, the fourth frame plate 24 includes a circuit board 241 having a flat shape in the present embodiment. The circuit board 241 is positioned at the outer surface of the fourth frame plate 24 corresponding to the first side of the fourth frame plate 24 in the third direction. The eight electrical contact surfaces 90 described above are provided at the outer surface of the circuit board 241 corresponding to the first side of the circuit board 241 in the third direction. Therefore, the electrical contact surfaces 90 face toward the first side of the third direction. That is, electrical contact surfaces 90 face toward the transfer belt 5 in the third direction. The casing 3 of the image forming apparatus 100 also includes the eight electrical contacts 303 capable of contacting the eight electrical contact surfaces 90.

As described above, when attaching the drum unit 1 to the image forming apparatus 100, the user first inserts the drum unit 1 into the interior space 6 of the casing 3 along the second direction. Subsequently, the user closes the cover 4, thereby causing the drum unit 1 to be moved in the fourth direction. This movement in the fourth direction includes a component of movement toward the first side of the third direction. Hence, the electrical contact surfaces 90 come into electrical contact with the electrical contacts 303 in the image forming apparatus 100, as illustrated in FIG. 7.

As described above, the electrical contact surfaces 90 in the drum unit 1 according to the present embodiment are provided at the outer surface of the fourth frame plate 24. Therefore, when the drum unit 1 is attached to the image forming apparatus 100, the electrical contact surfaces 90 can contact the electrical contacts 303 of the casing 3 of the image forming apparatus 100. Through this action, the IC chip 80 provided on the drum unit 1 can be electrically connected to the electrical contacts 303 of the casing 3 of the image forming apparatus 100.

As illustrated in FIG. 2, a handle 242 is also positioned at the outer surface of the fourth frame plate 24 in the present embodiment. The handle 242 is positioned between one end of the fourth frame plate 24 in the first direction and another end of the fourth frame plate 24 in the first direction. The one end of the fourth frame plate 24 in the first direction is positioned at the first side of the fourth frame plate 24 in the first direction. The other end of the fourth frame plate 24 in the first direction is positioned at the second side of the fourth frame plate 24 in the first direction. The electrical contact surfaces 90 are positioned closer to the one end of the fourth frame plate 24 in the first direction than the handle 242 is to the one end of the fourth frame plate 24 in the first direction. Stated differently, the electrical contact surfaces 90 are positioned closer to the one end of the fourth frame plate 24 in the first direction than to the other end of the fourth frame plate 24 in the first direction.

However, the electrical contact surfaces 90 may be positioned closer to the other end of the fourth frame plate 24 in the first direction than the handle 242 is to the other end of the fourth frame plate 24 in the first direction. That is, the electrical contact surfaces 90 may be positioned closer to the other end of the fourth frame plate 24 in the first direction than to the one end of the fourth frame plate 24 in the first direction.

Alternatively, the electrical contact surfaces 90 may be positioned between one end of the handle 242 in the first direction and another end of the handle 242 in the first direction.

<4. Modifications of the Embodiment>

While the description has been made in detail with reference to the embodiment thereof, it would be apparent to those skilled in the art that many modifications and variations may be made therein without departing from the spirit of the disclosure. Next, various modifications of the embodiment will be described while focusing on points of difference from the embodiment described above.

<4-1. First Modification>

Figure 8:
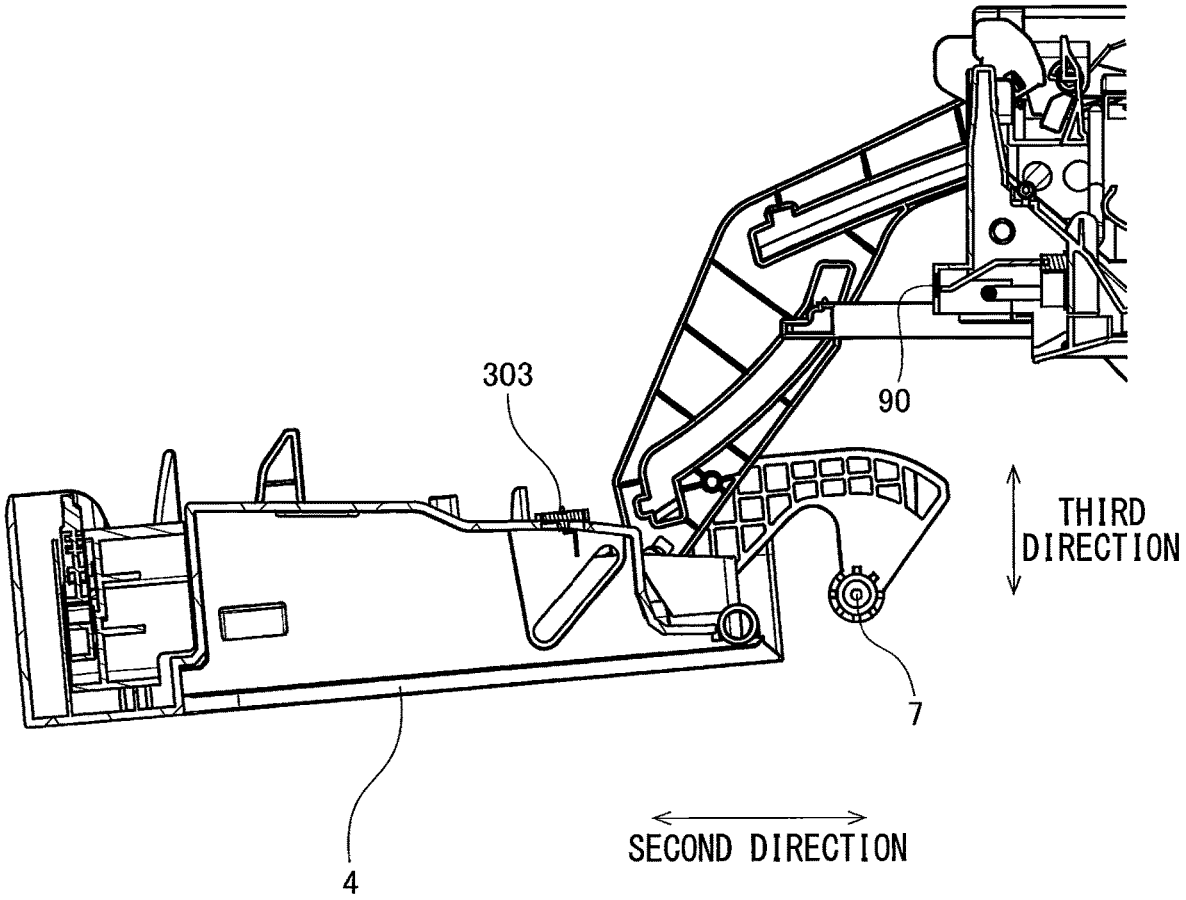
FIG. 8 is a partial cross-sectional view of an image forming apparatus according to a first modification.
Figure 9:
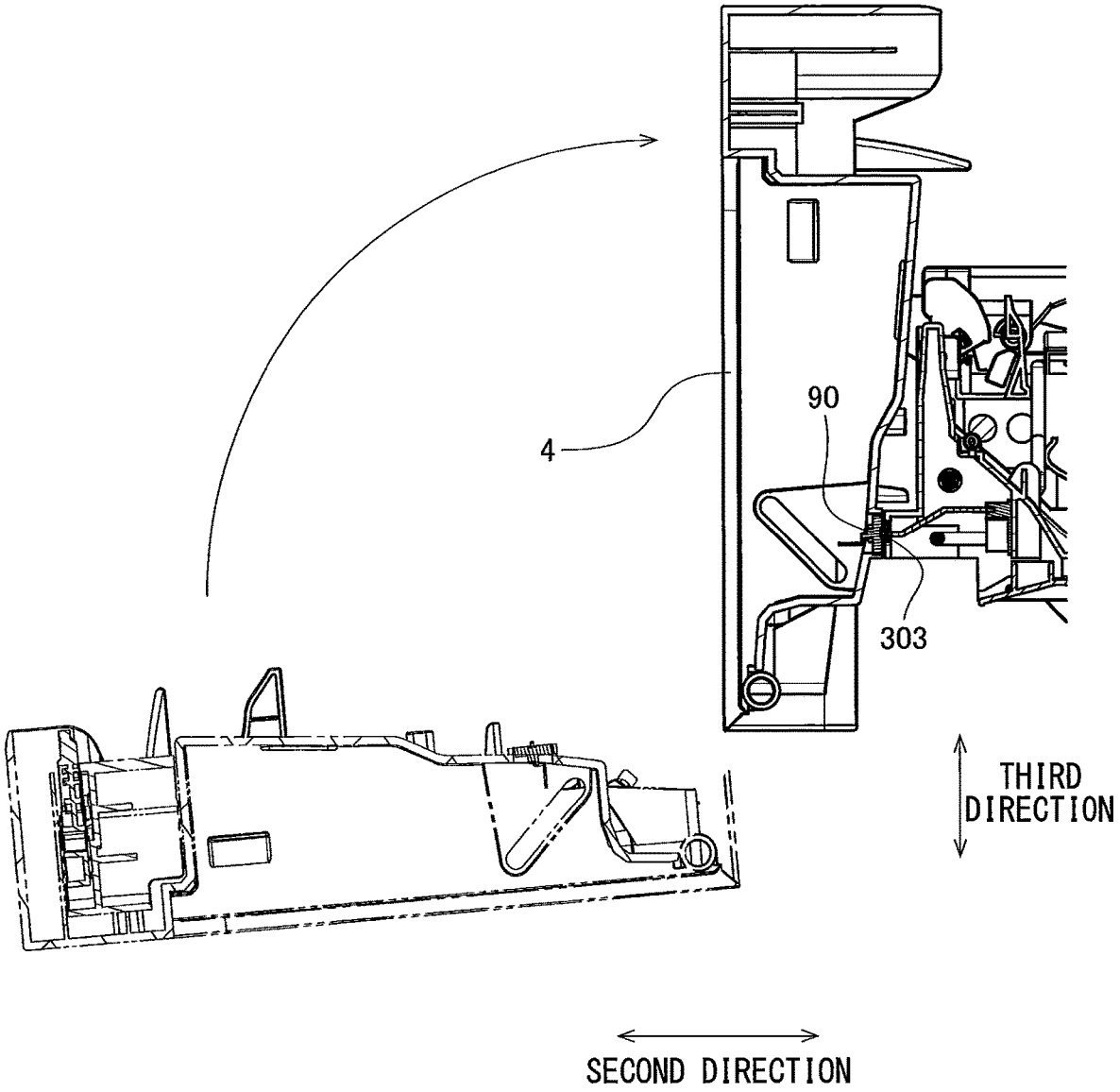
FIG. 9 is another partial cross-sectional view of an image forming apparatus according to a first modification.

FIGS. 8 and 9 are partial cross-sectional views of an image forming apparatus 100 according to a first modification. FIG. 8 illustrates a state in which the electrical contact surfaces 90 are not contacting electrical contacts 303 of the image forming apparatus 100. FIG. 9 illustrates a state in which the electrical contact surfaces 90 are contacting the electrical contacts 303 in the image forming apparatus 100.

In the embodiment described above, the eight electrical contact surfaces 90 are positioned at the outer surface of the fourth frame plate 24 corresponding to the first side of the third direction. Therefore, the electrical contact surfaces 90 face toward the first side (i.e., toward the transfer belt 5) in the third direction. However, in the first modification, the eight electrical contact surfaces 90 are positioned at the outer surface of the fourth frame plate 24 corresponding to the second side in the second direction. Therefore, the electrical contact surfaces 90 face toward the second side of the second direction. That is, the eight electrical contact surfaces 90 face in a direction away from the third frame plate 23 in the second direction.

Further, eight electrical contacts 303 configured to contact the eight electrical contact surfaces 90 are provided at the cover 4 of the image forming apparatus 100. The electrical contacts 303 are positioned at the surface of the cover 4 corresponding to the first side of the second direction when the cover 4 is in its closed position. Therefore, the electrical contacts 303 face toward the first side of the second direction when the cover 4 is in the closed position. That is, the electrical contacts 303 face in a direction toward the third frame plate 23 in the second direction in a state where the cover 4 is in the closed position.

When attaching the drum unit 1 to the image forming apparatus 100, the user first inserts the drum unit 1 into the interior space 6 of the casing 3 along the second direction. Then, the user pivotally moves the cover 4 from the open position to the closed position. When the cover 4 is placed in the closed position, the electrical contacts 303 contact with the electrical contact surfaces 90. Even with the above configuration, the electrical contact surfaces 90 can contact the electrical contacts 303 of the image forming apparatus 100 when the drum unit 1 is attached to the image forming apparatus 100.

<4-2. Second Modification>

In the embodiment and the first modification described above, the electrical contact surfaces 90 are positioned at the circuit board 241, which is provided at the outer surface of the fourth frame plate 24. However, as in a second modification, a connector may be positioned at the outer surface of the fourth frame plate 24 instead of the circuit board 241. In this case, the electrical contact surfaces 90 may be positioned at the connector. For example, the connector may be shaped so as to include a plurality of protrusions protruding in the fourth direction. In this case, the electrical contact surfaces 90 are positioned at the outer surfaces of the protrusions.

When attaching the drum unit 1 to the image forming apparatus 100, the user first inserts the drum unit 1 into the interior space 6 of the casing 3 along the second direction. Subsequently, the user closes the cover 4. Accordingly, the drum unit 1 is moved in the fourth direction. At this time, the connector provided on the drum unit 1 is fitted into a connector of the image forming apparatus 100. As a result, the eight electrical contact surfaces 90 can contact eight electrical contacts of the image forming apparatus 100.

<4-3. Third Modification>

In the embodiment and the first and second modifications described above, the electrical contact surfaces 90 are fixed to the fourth frame plate 24 so as to be incapable of moving relative to the same. However, the electrical contact surfaces 90 may be disposed so as to be movable in the second direction, the third direction, or the fourth direction relative to the fourth frame plate 24. Further, an elastic member may be positioned between the fourth frame plate 24 and the electrical contact surfaces 90.

The elastic member should be a member configured to expand and contract between a first state and a second state. The elastic member in the first state has a first distance between the fourth frame plate 24 and the electrical contact surfaces 90, while the elastic member in the second state has a second distance smaller than the first distance between the fourth frame plate 24 and the electrical contact surfaces 90. The elastic member may be in the first state in a state where the electrical contact surfaces 90 are separated from the electrical contacts 303 of the image forming apparatus 100, and may be in the second state in a state where the electrical contact surfaces 90 are contacting the electrical contacts 303 of the image forming apparatus 100.

By enabling the electrical contact surfaces 90 to be moved relative to the fourth frame plate 24 in this way, the electrical contact surfaces 90 can contact the electrical contacts 303 in the image forming apparatus 100 while reducing contact pressure between the electrical contacts 303 and the electrical contact surfaces 90. Here, the elastic member may be a coil spring, a torsion spring, a leaf spring, or a cushioning material, for example.

<4-4. Fourth Modification>

Figure 10:
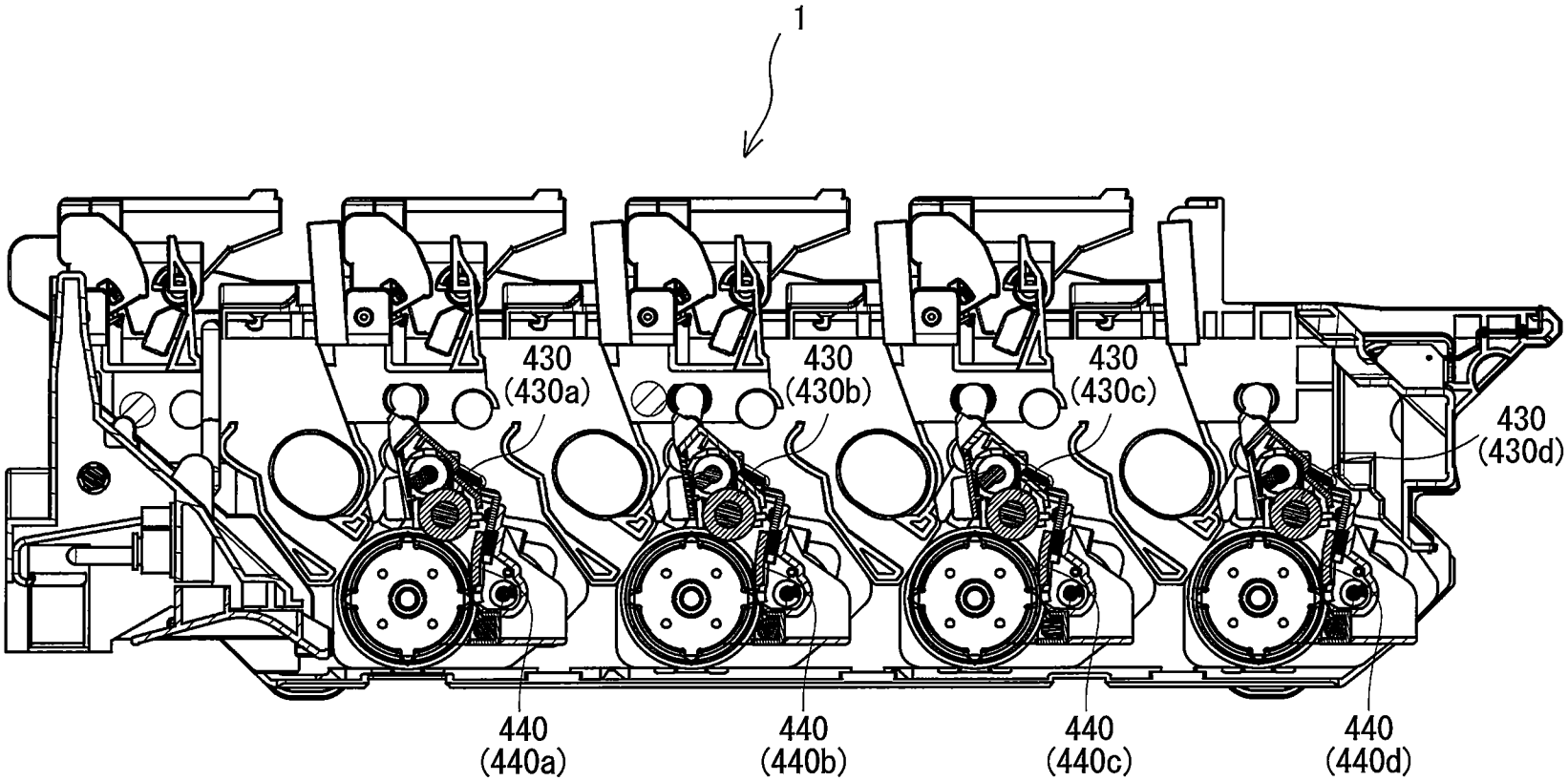
FIG. 10 is a cross-sectional view of a drum unit according to a fourth modification.

FIG. 10 is a cross-sectional view of a drum unit 1 according to a fourth modification. The drum unit 1 according to the above-described embodiment includes the scorotron chargers as the chargers 30. However, as illustrated in the fourth modification in FIG. 10, the drum unit 1 may include charging rollers serving as chargers 430. More specifically, in the fourth modification, the drum unit 1 includes a first charger 430*a*, a second charger 430*b*, a third charger 430*c*, and a fourth charger 430*d*. Further, the drum unit 1 according to the above-described embodiment includes cleaning rollers as the cleaning members 40. However, as in the fourth modification illustrated in FIG. 10, the drum unit 1 may include cleaning blades as cleaning members 440. More specifically, the drum unit 1 according to the fourth modification includes a first cleaning member 440*a*, a second cleaning member 440*b*, a third cleaning member 440*c*, and a fourth cleaning member 440*d*.

<4-5. Other Modifications>

In the embodiment described above, the four developing cartridges 2 are attachable to the single drum unit 1. However, the number of developing cartridges 2 attachable to the drum unit 1 may be two, three, or five or more.

In the embodiment described above, the IC chip 80 and the electrical contact surfaces 90 constitute the storage medium. However, the storage medium may have a storage unit other than an IC chip.

Detailed shapes of the drum unit and the image forming apparatus may differ from those illustrated in the drawings. Further, the components appearing in the above-described embodiment and the modifications may be suitably combined together avoiding conflicting combination.

What is claimed is:

1. A drum unit to which a developing cartridge is detachably attachable, the drum unit comprising:

a frame including:

a first frame plate;

a second frame plate spaced apart from the first frame plate in a first direction, the first frame plate having one end and another end in a second direction crossing the first direction and the second frame plate having one end and another end in the second direction;

a third frame plate extending in the first direction and connecting the one end of the first frame plate to the one end of the second frame plate; and a fourth frame plate extending in the first direction and connecting the another end of the first frame plate to the another end of the second frame plate, the fourth frame plate being spaced apart from the third frame plate in the second direction;

an electrical terminal positioned at the frame;

a relay board positioned at the frame and electrically connected to the electrical terminal;

a photosensitive drum rotatably supported by the first frame plate and the second frame plate about a first axis extending in the first direction;

a charger configured to charge an outer circumferential surface of the photosensitive drum, the charger being farther from the fourth frame plate than the first axis of the photosensitive drum is from the fourth frame plate in the second direction; and a storage medium including a memory and having an electrical contact surface positioned at an outer surface of the fourth frame plate, wherein the electrical contact surface includes a first electrical contact surface electrically connected to the memory, and a second electrical contact surface electrically connected to the electrical terminal through the relay board.

2. The drum unit according to claim 1, wherein a first distance between the fourth frame plate and the charger in the second direction is larger than a second distance between the fourth frame plate and the first axis of the photosensitive drum in the second direction.

3. The drum unit according to claim 2, wherein the outer circumferential surface of the photosensitive drum has a first outer circumferential surface positioned between the fourth frame plate and the first axis of the photosensitive drum in the second direction, and wherein the first distance is larger than a third distance between the fourth frame plate and the first outer circumferential surface of the photosensitive drum in the second direction.

4. The drum unit according to claim 1, wherein the charger includes a scorotron charger.

5. The drum unit according to claim 1, wherein the charger includes a charging roller.

6. The drum unit according to claim 1, further comprising a cleaning member configured to contact the outer circumferential surface of the photosensitive drum.

7. The drum unit according to claim 6, wherein the cleaning member is farther from the fourth frame plate than the first axis of the photosensitive drum is from the fourth frame plate in the second direction.

8. The drum unit according to claim 6, wherein the cleaning member includes a cleaning roller.

9. The drum unit according to claim 6, wherein the cleaning member includes a cleaning blade.

10. The drum unit according to claim 1, further comprising a circuit board positioned at the outer surface of the fourth frame plate, wherein the electrical contact surface is positioned at the circuit board.

11. The drum unit according to claim 1, wherein the relay board is positioned at an inner surface of the fourth frame plate.

12. The drum unit according to claim 11, wherein the electrical contact surface further includes a third electrical contact surface electrically connected to the memory and the electrical terminal.

13. The drum unit according to claim 1, wherein the fourth frame plate has one end and another end in the first direction, the electrical contact surface being positioned closer to the one end of the fourth frame plate than to the another end of the fourth frame plate.

14. The drum unit according to claim 1, wherein the electrical contact surface is movable relative to the fourth frame plate.

15. The drum unit according to claim 1, wherein the frame is configured to hold the developing cartridge.

16. An image forming apparatus comprising:

the drum unit according to claim 1; and a casing having an internal space therein for accommodating the drum unit.

17. The image forming apparatus according to claim 16, wherein the drum unit is configured to be inserted into the internal space of the casing in the second direction.

18. The image forming apparatus according to claim 16, further comprising:

a cover movable relative to the casing between an open position opening the internal space and a closed position closing the internal space, the cover being pivotally movable about a pivot shaft extending in the first direction; and a device-side contact configured to contact the electrical contact surface, wherein the electrical contact surface is configured to contact the device-side contact in accordance with the movement of the cover from the open position to the closed position.

19. The image forming apparatus according to claim 18, wherein the device-side contact is positioned at the cover, the device-side contact contacting the electrical contact surface in a state where the cover is in the closed position.

* * * * *